US011226570B2

(12) United States Patent
Hayasaka et al.

(10) Patent No.: US 11,226,570 B2
(45) Date of Patent: Jan. 18, 2022

(54) TONER AND DEVELOPER

(71) Applicant: RICOH COMPANY, LTD., Tokyo (JP)

(72) Inventors: Kohei Hayasaka, Kanagawa (JP); Tohru Moriya, Shizuoka (JP); Yousuke Suzuki, Shizuoka (JP); Atsushi Sasai, Shizuoka (JP); Kazuki Washizu, Shizuoka (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/899,855

(22) Filed: Jun. 12, 2020

(65) Prior Publication Data

US 2020/0401061 A1 Dec. 24, 2020

(30) Foreign Application Priority Data

Jun. 19, 2019 (JP) ..... JP2019-113644
Apr. 13, 2020 (JP) ..... JP2020-071921

(51) Int. Cl.
*G03G 9/08* (2006.01)
*G03G 9/097* (2006.01)
*G03G 9/087* (2006.01)

(52) U.S. Cl.
CPC ..... *G03G 9/09733* (2013.01); *G03G 9/0819* (2013.01); *G03G 9/0821* (2013.01); *G03G 9/08755* (2013.01); *G03G 9/08797* (2013.01)

(58) Field of Classification Search
CPC ..... G03G 9/09733; G03G 9/0821; G03G 9/08797
USPC ..... 430/111.4
See application file for complete search history.

(56) References Cited

U.S. PATENT DOCUMENTS

| | | | | |
|---|---|---|---|---|
| 2008/0311504 | A1 | 12/2008 | Hattori et al. | |
| 2010/0124716 | A1 | 5/2010 | Tomioka et al. | |
| 2011/0065033 | A1 | 3/2011 | Uchinokura et al. | |
| 2014/0072911 | A1 | 3/2014 | Suzuki et al. | |
| 2017/0023872 | A1* | 1/2017 | Ueda | G03G 9/0825 |
| 2017/0082933 | A1 | 3/2017 | Dan et al. | |
| 2017/0212442 | A1 | 7/2017 | Ogino et al. | |
| 2018/0329326 | A1 | 11/2018 | Matsushita et al. | |
| 2019/0011847 | A1 | 1/2019 | Ogawa et al. | |
| 2019/0294065 | A1* | 9/2019 | Morooka | G03G 9/08795 |
| 2019/0294066 | A1* | 9/2019 | Koide | G03G 9/08797 |

FOREIGN PATENT DOCUMENTS

| | | |
|---|---|---|
| JP | 2007-114804 | 5/2007 |
| JP | 2008-299055 | 12/2008 |
| JP | 2011-059595 | 3/2011 |
| JP | 2014-035533 | 2/2014 |
| JP | 2015-132654 | 7/2015 |
| JP | 2017-102399 | 6/2017 |

* cited by examiner

*Primary Examiner* — Mark A Chapman
(74) *Attorney, Agent, or Firm* — Grüneberg and Myers PLLC

(57) ABSTRACT

A toner comprising a binder resin and a release agent is provided. When the toner is subjected to a FTIR-ATR mapping within a measurement range in a 50 μm square, divided in 1,024 pixels each in a 1.56 μm square, an average value of an intensity ratio of an absorption spectrum peak at a wavenumber of 2850 $cm^{-1}$ to an absorption spectrum peak at a wavenumber of 828 $cm^{-1}$ in each of the pixels is from 0.10 to 0.19, and a proportion of pixels in which the intensity ratio is 0.20 or higher to all the pixels is from 5% to 10%.

12 Claims, No Drawings

TONER AND DEVELOPER

CROSS-REFERENCE TO RELATED APPLICATIONS

This patent application is based on and claims priority pursuant to 35 U.S.C. § 119(a) to Japanese Patent Application Nos. 2019-113644 and 2020-071921, filed on Jun. 19, 2019 and Apr. 13, 2020, respectively, in the Japan Patent Office, the entire disclosure of each of which is hereby incorporated by reference herein.

BACKGROUND

Technical Field

The present disclosure relates to a toner and a developer.

Description of the Related Art

In recent years, in the field of electrophotographic image forming technology, competition in development of color image forming apparatuses capable of forming images at high speed and low power has been intensifying.

To form an image at high speed and low power, the amount of heat for fixing a toner image should be reduced.

Toner generally contains a binder resin and a release agent to improve low-temperature fixability.

Such toners are known to adhere to a fixing roller or a fixing belt to cause a phenomenon called hot offset.

SUMMARY

In accordance with some embodiments of the present invention, a toner comprising a binder resin and a release agent is provided. When the toner is subjected to a FTIR-ATR mapping within a measurement range in a 50 μm square, divided in 1,024 pixels each in a 1.56 μm square, an average value of an intensity ratio of an absorption spectrum peak at a wavenumber of 2850 $cm^{-1}$ to an absorption spectrum peak at a wavenumber of 828 $cm^{-1}$ in each of the pixels is from 0.10 to 0.19, and a proportion of pixels in which the intensity ratio is 0.20 or higher to all the pixels is from 5% to 10%.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

A wax as the release agent is known to adhere to a photoconductor to cause a phenomenon called filming.

When such a toner is supplied using a MOHNO PUMP, the wax exudes from the toner and adheres to the rotor of the MOHNO PUMP. As a result, a gap is formed between the rotor and the stator and the differential pressure is reduced, resulting in defective toner supply.

Here, the MOHNO PUMP is a uniaxial eccentric screw pump including the rotor and the stator as main components. In the MOHNO PUMP, high hermeticity is achieved between the rotor and the stator, and frictional heat is generated as the rotor and the stator slidably rub each other. As a result, the wax easily exudes from the toner.

One embodiment of the present invention provides a toner that has excellent low-temperature fixability and hot offset resistance and is prevented from causing either filming or defective supply when using a MOHNO PUMP.

Embodiments of the present invention are described in detail below.

Toner

The toner according to an embodiment of the present invention contains a binder resin and a release agent (e.g., wax), and may further include a colorant, a charge controlling agent, and the like, as needed.

The toner of the present embodiment can be used to develop an electrostatic latent image formed on a photoconductor.

When the toner of the present embodiment is subjected to a FTIR-ATR mapping within a measurement range in a 50 μm square, divided in 1,024 pixels each in a 1.56 μm square, an average value of an intensity ratio ("$PI_{2850}/PI_{828}$") of an absorption spectrum peak at a wavenumber of 2850 $cm^{-1}$ to an absorption spectrum peak at a wavenumber of 828 $cm^{-1}$ in each of the pixels is from 0.10 to 0.19. When the average value of $PI_{2850}/PI_{828}$ of the toner is less than 0.10, hot offset resistance of the toner lowers. When it exceeds 0.19, filming and defective supply of the tonner when using a MOHNO PUMP occur.

In the toner of the present embodiment, a proportion of pixels in which the intensity ratio $PI_{2850}/PI_{828}$ is 0.20 or higher to all the pixels is from 5% to 10%. When the proportion of pixels in which the intensity ratio $PI_{2850}/PI_{828}$ is 0.20 or higher to all the pixels is less than 5%, hot offset resistance of the toner lowers. When it exceeds 10%, filming and defective supply of the toner when using a MOHNO PUMP occur.

Here, $PI_{2850}$ is the intensity of the peak derived from the release agent, and $PI_{828}$ is the intensity of the peak derived from the binder resin. Therefore, $PI_{2850}/PI_{828}$ indicates the relative amount of the release agent present near the surface of the toner.

In the toner of the present embodiment, a frequency histogram of $PI_{2850}/PI_{828}$ with respect to all the pixel has a half value width of preferably from 0.10 to 0.13, more preferably from 0.10 to 0.11. When the half value width of the frequency histogram of $PI_{2850}/PI_{828}$ with respect to all the pixel is 0.10 or more, hot offset resistance of the toner is further improved. When it is 0.13 or less, hot offset resistance of the toner is further improved, and in addition, the occurrence of filming and defective supply of the toner when using a MOHNO PUMP can be further prevented.

Preferably, the toner of the present embodiment has a volume average particle diameter of from 4.9 to 5.5 μm, more preferably from 4.9 to 5.2 μm. When the volume average particle diameter of the toner is 4.9 μm or more, the occurrence of filming is more prevented. When it is 5.5 μm or less, hot offset resistance of the toner is further improved.

The toner of the present embodiment may be either a magnetic toner or a non-magnetic toner.

Binder Resin

The binder resin can be suitably selected from known binder resins used for toner.

Examples of the binder resin include, but are not limited to: polyester; styrene homopolymers, such as polystyrene, poly p-styrene, and polyvinyl toluene, and derivatives thereof; styrene copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl-α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleate copolymer; and polymethyl methacrylate, polybutyl methacrylate, polyvinyl chloride, polyvinyl acetate, polyethylene, polypropylene, epoxy resin, epoxy polyol resin, polyurethane, polyamide, polyvinyl butyral, polyacrylic acid, rosin, modified rosin, terpene resin, aliphatic or alicyclic hydrocarbon resin, and aromatic petroleum resin. Two or more of these may be used in combination. Among these, polyester is preferred for its low-temperature fixability and glossiness of the resulting full-color image.

Examples of the polyester include, but are not limited to, unmodified polyester and urea-modified polyester.

The unmodified polyester may be synthesized by, for example, polycondensing a polyol and a polycarboxylic acid in an inert gas atmosphere using a known esterification catalyst, if necessary, at from 120 to 230 degrees C.

The polyol can be appropriately selected from known polyols used to synthesize unmodified polyester.

Examples of the polyol include, but are not limited to: alkylene glycols such as ethylene glycol, 1,2-propylene glycol, 1,3-propylene glycol, 1,4-butanediol and 1,6-hexanediol; polyalkylene glycols such as diethylene glycol, triethylene glycol, dipropylene glycol, polyethylene glycol, polypropylene glycol, and polybutylene glycol; alicyclic dialcohols such as 1,4-cyclohexanedimethanol and hydrogenated bisphenol A; alkylene oxide adducts of alicyclic dialcohols obtained by adding alkylene oxides such as ethylene oxide, propylene oxide, and butylene oxide to alicyclic dialcohols; bisphenols such as bisphenol A, bisphenol F, and bisphenol S; and alkylene oxide adducts of bisphenols obtained by adding alkylene oxides such as ethylene oxide, propylene oxide, and butylene oxide to bisphenols. Two or more of these may be used in combination. Among these, alkylene glycols having 2 to 12 carbon atoms, and alkylene oxide adducts of bisphenols are preferred; and alkylene oxide adducts of bisphenols, and mixtures of an alkylene oxide adduct of bisphenols with an alkylene glycol having 2 to 12 carbon atoms are more preferred.

The polycarboxylic acid can be appropriately selected from known polycarboxylic acids used to synthesize unmodified polyester.

Examples of the polycarboxylic acid include, but are not limited to, divalent carboxylic acids, trivalent or higher carboxylic acids, and mixtures of a divalent carboxylic acid with a trivalent or higher carboxylic acid. Among these, divalent carboxylic acids, and mixtures of a divalent carboxylic acid with a trivalent or higher carboxylic acid are preferred.

Examples of the divalent carboxylic acids include, but are not limited to, alkylene dicarboxylic acids such as succinic acid, adipic acid, and sebacic acid; alkenylene dicarboxylic acids such as maleic acid and fumaric acid; aromatic dicarboxylic acids such as phthalic acid, isophthalic acid, terephthalic acid, and naphthalenedicarboxylic acid. Two or more of these may be used in combination. Among these, alkenylene dicarboxylic acids having 4 to 20 carbon atoms and aromatic dicarboxylic acids having 8 to 20 carbon atoms are preferred.

Examples of the trivalent or higher carboxylic acids include, but are not limited to, trivalent or higher aromatic carboxylic acids such as trimellitic acid and pyromellitic acid. Two or more of these may be used in combination. Among these, trivalent or higher aromatic carboxylic acids having 9 to 20 carbon atoms are preferred.

In addition, anhydrides and lower alkyl esters of polycarboxylic acids can be used in place of polycarboxylic acids.

Examples of the lower alkyl esters include, but are not limited to, methyl ester, ethyl ester, and isopropyl ester.

Examples of the esterification catalyst include, but are not limited to, organotin compounds (e.g., dibutyltin oxide), organic titanium compounds, and organic zirconium compounds.

The unmodified polyester may be synthesized by, for example, polycondensing a diol and a dicarboxylic acid and then further polycondensing with addition of a trivalent or higher alcohol and/or a trivalent or higher carboxylic acid.

The unmodified polyester has a glass transition temperature of preferably from 30 to 80 degrees C., more preferably from 40 to 65 degrees C. When the glass transition temperature of the binder resin is 30 degrees C. or higher, heat-resistant storage stability of the toner is improved. When it is 80 degrees C. or lower, low-temperature fixability of the toner is improved.

The unmodified polyester has a weight average molecular weight of preferably from 2,000 to 90,000, more preferably from 2,500 to 30,000. When the weight average molecular weight of the binder resin is 2,000 or more, heat-resistant storage stability of the toner is improved. When it is 90,000 or less, low-temperature fixability of the toner is improved.

The urea-modified polyester may be produced by, for example, reacting a polyester prepolymer having an isocyanate group with an amine at the time of producing a toner, as described later.

The polyester prepolymer having an isocyanate group can be synthesized by reacting an unmodified polyester having a hydroxyl group with a polyisocyanate.

The polyol and polycarboxylic acid used to synthesize the unmodified polyester having a hydroxyl group are the same as the above-described polyol and polycarboxylic acid.

The polyisocyanate can be appropriately selected from known polyisocyanates used to synthesize polyester prepolymers having an isocyanate group.

Examples of the polyisocyanate include, but are not limited to, aliphatic polyisocyanates such as tetramethylene diisocyanate, hexamethylene diisocyanate, 2,6-diisocyanatomethyl caproate, octamethylene diisocyanate, decamethylene diisocyanate, dodecamethylene diisocyanate, tetradecamethylene diisocyanate, trimethylhexane diisocyanate, and tetramethylhexane diisocyanate; alicyclic polyisocyanates such as isophorone diisocyanate and cyclohexylmethane diisocyanate; aromatic diisocyanates such as tolylene diisocyanate, diphenylmethane diisocyanate, 1,5-naphthylene diisocyanate, diphenylene-4,4'-diisocyanate, 4,4'-diisocyanato-3,3'-dimethyldiphenyl, 3-methyldiphenylmethane-4,4'-diisocyanate, and diphenyl ether-4,4'-diisocyanate; araliphatic diisocyanates such as α,α,α',α'-tetramethylxylylene diisocyanate; and isocyanurates such as tris(isocyanatoalkyl) isocyanurate and triisocyanatocycloalkyl isocyanurate. Two or more of these may be used in combination. Among these, isophorone diisocyanate is preferred in view of toner quality.

The amine can be appropriately selected from known amines used to synthesize urea-modified polyester.

Examples of the amine include, but are not limited to, diamines, trivalent or higher amines, amino alcohols, amino mercaptans, and amino acids. Two or more of these may be used in combination. Among these, diamines, and mixtures of a diamine with a small amount of a trivalent or higher amine are preferred.

Examples of the diamines include, but are not limited to: aromatic diamines such as phenylenediamine, diethyltoluenediamine, and 4,4'-diaminodiphenylmethane; alicyclic diamines such as 4,4'-diamino-3,3'-dimethyldicyclohexylmethane, diaminocyclohexane, and isophoronediamine; and aliphatic diamines such as ethylenediamine, tetramethylenediamine, and hexamethylenediamine.

Examples of the trivalent or higher amines include, but are not limited to, diethylenetriamine and triethylenetetramine.

Examples of the amino alcohols include, but are not limited to, ethanolamine and hydroxyethyl aniline.

Examples of the amino mercaptans include, but are not limited to, aminoethyl mercaptan and aminopropyl mercaptan.

Examples of the amino acids include, but are not limited to, aminopropionic acid and aminocaproic acid.

The amino group of the amines may be protected by a protecting group.

Release Agent

The release agent can be appropriately selected from known release agents used for toners.

Examples of the release agent include, but are not limited to: polyolefin waxes such as polyethylene wax, polypropylene wax, and modified polyethylene wax; synthetic waxes such as Fischer-Tropsch wax; petroleum waxes such as ester wax, paraffin wax, and micro-crystalline wax; and plant waxes such as carnauba wax, candelilla wax, rice wax, and hydrogenated castor oil. Two or more of these may be used in combination. Among these, ester wax is preferred for hot offset resistance of the toner.

Examples of commercially-available ester waxes include WEP series (manufactured by NOF CORPORATION).

Examples of commercially-available paraffin waxes include HNP series (manufactured by Nippon Seiro Co., Ltd.).

The ester wax has a melting point of preferably from 70 to 80 degrees C., more preferably from 70 to 75 degrees C. When the melting point of the ester wax is 70 degrees C. or higher, the occurrence of filming and defective supply of the toner when using a MOHNO PUMP are prevented. When it is 80 degrees C. or lower, hot offset resistance of the toner is further improved.

Colorant

The colorant can be appropriately selected from known dyes and pigments used for toner. Specific examples of the colorant include, but are not limited to, carbon black, Nigrosine dyes, black iron oxide, NAPHTHOL YELLOW S, HANSA YELLOW (10G, 5G, and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red FSR, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarin Lake, Thioindigo Red B, Thioindigo Maroon, Oil Red, Quinacridone Red, Pyrazolone Red, polyazo red, Chrome Vermilion, Benzidine Orange, perinone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, and lithopone. Two or more of these colorants can be used in combination.

A proportion of the colorant in the toner is preferably from 1% to 15% by mass, more preferably from 3% to 10% by mass.

The colorant can be combined with a binder resin to be used as a master batch.

Here, the binder resin of the master batch is the same as the above-described binder resin.

The master batch can be manufactured by mixing and kneading the binder resin and the colorant with application of a shearing force. At this time, an organic solvent can be used to improve the interaction between the colorant and the binder resin. Further, a method called flushing may also be employed, in which an aqueous paste of the colorant is mixed and kneaded with the binder resin and an organic solvent, so that the colorant is transferred to the binder resin side, followed by removal of water and the organic solvent. In this case, since the wet cake of the colorant can be used as it is, it is not necessary to dry the wet cake of the colorant.

It is preferable that the binder resin and the colorant be mixed and kneaded using a high shear disperser such as a three-roll mill.

Charge Controlling Agent

The charge controlling agent can be appropriately selected from known charge controlling agents used for toners.

Examples of the charge controlling agent include, but are not limited to, nigrosine dyes, triphenylmethane dyes, chromium-containing metal complex dyes, molybdic acid chelate pigments, rhodamine dyes, alkoxyamines, quaternary ammonium salts (including fluorine-modified quaternary ammonium salts), alkyl amides, simple substances or compounds of phosphorus, simple substances or compounds of tungsten, fluorine-based surfactants, metal salts of salicylic acid or derivatives thereof, copper phthalocyanine, perylene, quinacridone, azo pigments, and polymer compounds having sulfonate group, carboxyl group, quaternary ammonium base, or the like. Two or more of these may be used in combination.

Examples of commercially-available charge controlling agents include, but are not limited to: BONTRON 03 (nigrosine dye), BONTRON P-51 (quaternary ammonium salt), BONTRON S-34 (metal-containing azo dye), BONTRON E-82 (metal complex of oxynaphthoic acid), BONTRON E-84 (metal complex of salicylic acid), and BONTRON E-89 (phenolic condensation product), all manufactured by Orient Chemical Industries Co., Ltd.; TP-302 and TP-415 (molybdenum complexes of quaternary ammonium salts) manufactured by Hodogaya Chemical Co., Ltd.; COPY CHARGE PSY VP2038 (quaternary ammonium salt), COPY BLUE PR (triphenylmethane derivative), and COPY CHARGE NEG VP2036 and COPY CHARGE NX VP434 (quaternary ammonium salts), all manufactured by Hoechst AG; and LR-147 (boron complex) manufactured by Japan Carlit Co., Ltd.

The mass ratio of the charge controlling agent to the binder resin is preferably from 0.1% to 10%, more preferably from 0.2% to 5%.

The charge controlling agent may be combined with a binder resin to be used as a master batch or may be fixed on the surfaces of base particles of the toner.

Here, the binder resin of the master batch is the same as the above-described binder resin.

Organically-Modified Layered Inorganic Mineral

Preferably, the toner of the present embodiment further contains an organically-modified layered inorganic mineral. This makes it possible to control the shape of the toner and to finely disperse components such as the colorant and the release agent in base particles of the toner.

The organically-modified layered inorganic mineral is a layered inorganic mineral in which at least a part of ions present between the layers are modified with organic ions. The layered inorganic mineral is an inorganic mineral formed of laminated layers each having a thickness of several nanometers.

Here, "at least a part of ions present between the layers of a layered inorganic mineral are modified with organic ions" means that the organic ions are introduced as at least a part of the ions present between the layers of the layered inorganic mineral. Introduction of organic ions also includes intercalation of organic ions in a broad sense.

Examples of the layered inorganic mineral include, but are not limited to, smectite-group clay minerals (e.g., montmorillonite, saponite, hectorite), kaolin-group clay minerals (e.g., kaolinite), bentonite, attapulgite, magadiite, and kanemite. Two or more of these may be used in combination. Among these, smectite-group clay minerals are preferred, and montmorillonite is particularly preferred.

Examples of the organic ions include, but are not limited to: quaternary alkylammonium ions, phosphonium ion, and imidazolium ion; branched, unbranched, or cyclic alkyl groups having 1 to 44 carbon atoms, branched, unbranched, or cyclic alkenyl groups having 1 to 22 carbon atoms, branched, unbranched, or cyclic alkoxy groups having 8 to 32 carbon atoms, branched, unbranched, or cyclic hydroxyalkyl groups having 2 to 22 carbon atoms, sulfate ions having a backbone such as ethylene oxide and propylene oxide, sulfonate ions having such a backbone, carboxylate ions having such a backbone, and phosphate ions having such a backbone. Two or more of these may be used in combination. Among these, quaternary alkylammonium ions and carboxylate ions having an ethylene oxide backbone are preferred, and quaternary alkylammonium ions are particularly preferred.

Examples of the quaternary alkylammonium ions include, but are not limited to, trimethylstearylammonium ion, dimethyl stearylbenzylammonium ion, dimethyloctadecylammonium ion, and oleylbis(2-hydroxyethyl)methylammonium ion.

Whether or not at least a part of ions present between the layers of the layered inorganic mineral are modified with organic ions can be confirmed by gas chromatography mass spectrometry (GCMS), for example, as follows. The toner is mixed with a solvent to prepare a liquid in which the binder resin is dissolved, then the liquid is filtered. The filtered cake is pyrolyzed at 550 degrees C. using a pyrolyzer Py-2020D (manufactured by Frontier Laboratories Ltd.) and analyzed using a GCMS apparatus QP5000 (manufactured by Shimadzu Corporation) to identify organic ions.

The organically-modified layered inorganic mineral may be obtained by, for example, introducing metal anions by substituting a part of divalent metals constituting the layered inorganic mineral with trivalent metals, then modifying at least a part of the metal anions with organic anions.

Examples of commercially-available organically-modified layered inorganic minerals include, but are not limited to: quaternium-18 bentonite, such as BENTONE 3, BENTONE 38, and BENTONE 38V (manufactured by Elementis Specialties), TIXOGEL VP (manufactured by United Catalyst Corporation), and CLAYTONE 34, CLAYTONE 40, and CLAYTONE XL (manufactured by Southern Clay Products, Inc.); stearalkonium bentonite, such as BENTONE 27 (manufactured by Rheox, Inc.), TIXOGEL LG (manufactured by BYK Additives & Instruments), and CLAYTONE AF and CLAYTONE APA (manufactured by BYK Additives & Instruments); quaternium-18/benzalkonium bentonite such as CLAYTONE HT and CLAYTONE PS (manufactured by Southern Clay Products, Inc.), organically-modified montmorillonite such as CLAYTONE HY (manufactured by Southern Clay Products, Inc.); and organically-modified smectite such as LUCENTITE (available from Co-op Chemical Co., Ltd.). Among these, CLAYTONE AF and CLAYTONE APA are particularly preferred.

The organically-modified layered inorganic mineral is preferably synthesized by modifying DHT-4A (manufactured by Kyowa Chemical Industry Co., Ltd.) with a compound represented by a general formula (1): $R_1(OR_2)_nOSO_3M$ (where $R_1$ represents an alkyl group having 1 to 3 carbon atoms, $R_2$ represents an alkylene group having 2 to 6 carbon atoms, n represents an integer of from 2 to 10, and M represents a monovalent metal cation).

Examples of the compound represented by the general formula (1) include, but are not limited to, HITENOL 330T (manufactured by DKS Co., Ltd.).

The organically-modified layered inorganic mineral may be combined with a binder resin to be used as a masterbatch.

Here, the binder resin of the master batch is the same as the above-described binder resin.

The proportion of the organically-modified layered inorganic mineral in the toner of the present embodiment is preferably from 0.1% to 3.0% by mass, more preferably from 0.3% to 1.5% by mass. When the proportion of the organically-modified layered inorganic mineral in the toner is 0.1% by mass or more, the effect of the organically-modified layered inorganic mineral is easily exhibited. When the proportion is 3.0% by mass or less, low-temperature fixability of the toner is improved.

Method for Manufacturing Toner

The method for manufacturing the toner of the present embodiment can be appropriately selected from known methods for manufacturing toner. Examples thereof include, but are not limited to, pulverization methods and dissolution suspension methods. Among these, dissolution suspension methods are preferred for easy control of $PI_{2850}/PI_{828}$.

One method for manufacturing the toner by a pulverization method is described below.

First, a toner composition including an unmodified polyester, a release agent, a colorant, a polyester prepolymer having an isocyanate group, an amine, and an organically-modified layered inorganic mineral is melt-kneaded using a kneader to prepare a kneaded product of the toner composition.

Examples of the kneader include, but are not limited to, closed kneaders and open-roll kneaders. Open-roll kneaders are preferred for easy control of $PI_{2850}/PI_{828}$.

Next, the kneaded product of the toner composition is pulverized using a pulverizer to prepare base particles.

Examples of the pulverizer include, but are not limited to, airflow pulverizers (e.g., jet mill) and mechanical pulverizers (e.g., turbo mill).

Next, inorganic particles are externally added to the base particles to prepare a toner.

The inorganic particles can be appropriately selected from known inorganic particles used for toners. Examples thereof include, but are not limited to, silica particles and titanium oxide particles.

A device used to externally add the inorganic particles to the base particles can be appropriately selected from known devices. Examples thereof include, but are not limited to, mixers.

One method for manufacturing the toner a dissolution suspension method is described below.

First, a toner composition including an unmodified polyester, a release agent, a colorant, a polyester prepolymer having an isocyanate group, an amine, and an organically-modified layered inorganic mineral is dispersed in an organic solvent to prepare a first liquid.

The organic solvent can be appropriately selected from known organic solvents used for dissolution suspension methods. Examples thereof include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. Two or more of these may be used in combination. Among these, toluene, xylene, benzene, methylene chloride, 1,2-dichloroethane, chloroform, and carbon tetrachloride are preferred, and ethyl acetate is particularly preferred.

Preferably, the organic solvent has a boiling point less than 150 degrees C. This facilitates removal of the organic solvent after formation of the base particles.

The mass ratio of the organic solvent to the toner composition is preferably from 0.4 to 3, more preferably from 0.6 to 1.4, and most preferably from 0.80 to 1.2.

A disperser used to disperse the toner composition in the organic solvent is not particularly limited, but a high-speed shear disperser and a media disperser are preferred for fine dispersion of the toner composition.

The high-speed shear disperser is capable of finely dispersing the toner composition by pulverizing the toner composition with a high shearing force generated in a narrow gap between the rotor and the stator.

Examples of the high-speed shear disperser include, but are not limited to, an emulsifying disperser MILDER.

The media disperser is capable of finely dispersing the toner composition by pulverizing the toner composition by rotating a vessel filled with media such as zirconia bead to cause collision between the media or between the media and the vessel.

Examples of the media disperser include, but are not limited to, a bead mill.

The media disperser is effective for pulverizing materials having a size of greater than 1 μm. On the other hand, the high-speed shear disperser is effective for pulverizing materials of submicron order. The media disperser and the high-speed shear disperser differ in the size of the main pulverizing target. Therefore, it is preferable to use the media disperser and the high-speed shear disperser in combination to improve uniformity of the material. In this case, the order of using the media disperser and the high-speed shear disperser is not particularly limited.

The peripheral speed of the rotor of the high-speed shear disperser is preferably more than 12 m/s. In this case, the material can be efficiently pulverized.

The peripheral speed of the disk of the media disperser is preferably 6 m/s or more, more preferably from 10 to 12 m/s. When the peripheral speed of the disk of the media disperser is 6 m/s or more, the material can be efficiently pulverized.

The diameter of the media of the media disperser is preferably 0.5 mm or less, more preferably 0.3 mm or less. When the diameter of the media of the media disperser is 0.5 mm or less, the material can be efficiently pulverized.

Here, since the toner composition contains the organically-modified layered inorganic mineral having a hardness higher than that of organic compounds, base particles having a non-uniform composition can be reduced.

This is because, in addition to collisions between the media and collisions between the media and the vessel, collisions between the media and the organically-modified layered inorganic mineral and between the vessel and the organically-modified layered inorganic mineral occur. As a result, the organic compounds having a low hardness can be efficiently pulverized.

The proportion of the organically-modified layered inorganic mineral in the toner composition is preferably from 0.2% to 2.0% by mass, more preferably from 0.7% to 1.5% by mass. When the proportion of the organically-modified layered inorganic mineral in the toner composition is from 0.2% to 2.0% by mass, base particles having a non-uniform composition can be reduced.

Next, the first liquid is dispersed in an aqueous medium to prepare a second liquid.

The mass ratio of the aqueous medium to the first liquid is preferably from 0.5 to 20, more preferably from 1 to 10. When the mass ratio of the aqueous medium to the first liquid is 0.5 or more, dispersibility of the second liquid is improved. When it is 20 or less, it is economical.

The aqueous medium contains water, and may further contain an organic solvent, if necessary.

The organic solvent can be appropriately selected from known water-miscible organic solvents. Examples thereof include, but are not limited to, alcohols (e.g., methanol, isopropyl alcohol, ethylene glycol), dimethylformamide, tetrahydrofuran, cell osolves (e.g., methyl cellosolve), and lower ketones (e.g., acetone, methyl ethyl ketone).

The aqueous medium preferably further contains a dispersant such as a surfactant, resin particles, and an inorganic compound dispersant.

The surfactant can be appropriately selected from known surfactants. Examples thereof include, but are not limited to: anionic surfactants such as alkylbenzene sulfonate, α-olefin sulfonate, and phosphates; amine-salt-based cationic surfactants such as alkyl amine salts, amino alcohol fatty acid derivatives, polyamine fatty acid derivatives, and imidazoline; quaternary-ammonium-salt-based cationic surfactants such as alkyltrimethylammonium salts, dialkyldimethylammonium salts, alkyldimethylbenzylammonium salts, pyridinium salts, alkylisoquinolinium salts, and benzethonium chloride; nonionic surfactants such as fatty acid amide derivatives and polyol derivatives; and amphoteric surfactants such as alanine, dodecylbis(aminoethyl) glycine, bis (octylaminoethyl) glycine, and N-alkyl-N,N-dimethylammonium betaine.

Further, a surfactant having a fluoroalkyl group may be used as the surfactant.

The resin constituting the resin particles may be either a thermoplastic resin or a thermosetting resin.

The resin constituting the resin particles can be appropriately selected from known resins capable of forming an aqueous dispersion. Examples thereof include, but are not limited to, vinyl resin, polyurethane, epoxy resin, polyester, polyamide, polyimide, silicon-based resin, phenol resin, melamine resin, urea resin, aniline resin, ionomer resin, and polycarbonate. Two or more of these may be used in combination. Among these, vinyl resin, polyurethane, epoxy resin, and polyester are preferred because it is easy to obtain an aqueous dispersion of fine and spherical particles thereof.

Examples of the vinyl resin include, but are not limited to, styrene-(meth)acryate copolymer, styrene-butadiene copolymer, (meth)acrylic acid-acrylate copolymer, styrene-acrylonitrile copolymer, styrene-maleic anhydride copolymer, and styrene-(meth)acrylic acid copolymer.

The resin particles have a volume average particle diameter of preferably from 5 to 200 nm, more preferably from 20 to 300 nm.

Examples of the inorganic compound dispersant include, but are not limited to, tricalcium phosphate, calcium carbonate, titanium oxide, colloidal silica, and hydroxyapatite.

It may be possible to use the resin particles and the inorganic compound dispersant in combination with a polymer protective colloid to improve dispersion stability of the second liquid.

Examples of polymer compounds constituting the polymer protective colloid include, but are not limited to, homopolymers and copolymers of: monomers having a carboxyl group (e.g., acrylic acid, methacrylic acid, α-cyanoacrylic acid, α-cyanomethacrylic acid, itaconic acid, crotonic acid, fumaric acid, maleic acid, maleic anhydride); (meth)acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate, glycerin monomethacrylate, N-methylol acrylamide, N-methylol methacrylamide); vinyl alcohols; vinyl alkyl ethers (e.g., vinyl methyl ether, vinyl ethyl ether, vinyl propyl ether); carboxylic acid vinyl esters (e.g.; vinyl acetate, vinyl propionate, vinyl butyrate); acrylamide, methacrylamide, diacetone acrylamide, and methylol compounds thereof; acid chlorides (e.g., acrylic acid chloride, methacrylic acid chloride); and nitrogen-containing compounds (e.g., vinylpyridine, vinylpyrrolidone, vinylimidazole, ethyleneimine).

Examples of polymer compounds constituting the polymer protective colloid further include, but are not limited to: polyoxyethylene compounds such as polyoxyethylene, polyoxypropylene, polyoxyethylene alkylamine, polyoxypropylene alkylamine, polyoxyethylene alkylamide, polyoxypropylene alkylamide, polyoxyethylene nonyl phenyl ether, polyoxyethylene lauryl phenyl ether, polyoxyethylene stearyl phenyl ester, and polyoxyethylene nonyl phenyl ester; and celluloses such as methyl cellulose, hydroxyethyl cellulose, and hydroxypropyl cellulose.

A disperser used to disperse the first liquid in the aqueous medium can be appropriately selected from known dispersers. Examples thereof include, but are not limited to, low-speed shear dispersers, high-speed shear dispersers, friction dispersers, high-pressure jet dispersers, and ultrasonic dispersers. Among these, high-speed shear dispersers are preferred because they can adjust the particle size of the second liquid to 2 to 20 μm.

When the high-speed shear disperser is used, the number of revolutions is preferably from 1,000 to 30,000 rpm, more preferably from 5,000 to 20,000 rpm.

When the high-speed shear disperser is used, the dispersing time is preferably from 0.1 to 5 minutes in the case of a batch method.

When the high-speed shear disperser is used, the temperature is preferably from 0 to 150 degrees C. (under pressure), more preferably from 40 to 98 degrees C.

Next, the organic solvent is removed from the second liquid to form base particles, thus preparing a third liquid.

Specifically, spindle-shaped base particles can be formed by, for example, gradually raising the temperature of the entire system stirred under a laminar flow and stirring the system strongly within a certain temperature range, to cause a polyester prepolymer having an isocyanate group react with an amine, followed by removal of the solvent.

Next, the base particles contained in the third liquid are washed and dried.

When tricalcium phosphate is used as the inorganic compound dispersant that is acid- or alkali-soluble, the tricalcium phosphate is dissolved with an acid such as hydrochloric acid and then washed away with water, so that the tricalcium phosphate is removed from the base particles.

Alternatively, the dispersant can be removed by another operation such as decomposition with an enzyme.

Next, inorganic particles are externally added to the base particles to prepare a toner. The inorganic particles can be appropriately selected from known inorganic particles used for toners. Examples thereof include, but are not limited to, silica particles and titanium oxide particles.

A device used to externally add the inorganic particles to the base particles can be appropriately selected from known devices. Examples thereof include, but are not limited to, mixers.

Developer

A developer of the present embodiment includes the toner of the present embodiment and a carrier.

Carrier

The carrier can be appropriately selected from known carriers used for developers. Examples thereof include, but are not limited to, a carrier in which a coating film is formed on a core material.

The core material can be appropriately selected from known core materials used for carriers. Examples thereof include, but are not limited to, ferrite containing a divalent metal such as iron, manganese, zinc, and copper.

The resin constituting the coating film can be appropriately selected from known resins constituting coating films for carriers. Examples thereof include, but are not limited to, silicone resin, styrene-acrylic resin, fluororesin, and olefin resin.

The coating film has a thickness of preferably from 0.05 to 10 μm, more preferably from 0.3 to 4 μm.

The method for forming the coating film can be appropriately selected from known methods for forming a coating film on a carrier. Examples thereof include, but are not limited to, a method of spraying a resin solution to a fluidized bed of the core material, and a method of electrostatically adhering resin particles to the core material and then heat-melting the resin particles.

The carrier has a weight average particle diameter of preferably from 20 to 100 μm. When the weight average particle diameter of the carrier is 20 μm or more, the carrier is less likely to adhere to a photoconductor at the time of image development. When it is 100 μm or less, poor charging of the toner is less likely to occur during continuous use.

EXAMPLES

The present invention is further described in detail with reference to the following Examples but is not limited thereto. In the following descriptions, "parts" represent "parts by mass" unless otherwise specified.

Wax Properties Measuring Methods

[1] Melting Point

The melting point was determined by obtaining a DSC curve using TA-60WS and DSC-60 (manufactured by Shimadzu Corporation) under the following measurement conditions, and then analyzing the DSC curve using a data analysis software program TA-60 version 1.52 (manufactured by Shimadzu Corporation).

Sample container: Aluminum sample pan (with a lid)

Sample quantity: 5 mg

Reference: Aluminum sample pan (containing 10 mg of alumina)

Atmosphere: Nitrogen (Flow rate: 50 ml/min)

Start temperature: 20 degrees C.

Temperature rising rate: 10 degrees C./min

End temperature: 150 degrees C.

Retention time: None

Temperature falling rate: 10 degrees C./min

End temperature: 20 degrees C.

Retention time: None

Temperature rising rate: 10 degrees C./min

End temperature: 150 degrees C.

Method of Measuring Toner Properties

[1] $PI_{2850}/PI_{828}$

A toner pellet having a diameter of 40 mm and a thickness of about 2 mm was subjected to a FTIR-ATR mapping using SPOTLIGHT 400 FT-IR IMAGING SYSTEM (manufactured by PerkinElmer, Inc.) within a measuring range in a 50 μm square, which was divided in 1,024 pixels each in a 1.56 μm square, to determine the average value of $PI_{2850}/PI_{828}$ in each of the pixels, the proportion of pixels in which $PI_{2850}/PI_{828}$ was 0.20 or more to all the pixels, and the half value width of the frequency histogram of $PI_{2850}/PI_{828}$ with respect to all the pixels.

The toner pellet was prepared by pressing 3 g of toner for 1 minute with a load of 6 tons using an automatic pelletizer Type M No. 50 BRP-E (manufactured by MAEKAWA TESTING MACHINE MFG. Co., Ltd.).

[2] Volume Average Particle Diameter

First, 0.1 to 5 ml of a surfactant alkylbenzene sulfonate was added to 100 to 150 ml of an electrolytic solution ISOTON-II (manufactured by Beckman Coulter, Inc.), then 2 to 20 mg of toner was added thereto and dispersed using an ultrasonic disperser for about 1 to 3 minutes. Next, the volume average particle diameter of the toner was determined using a precision particle size distribution analyzer MULTISIZER II (manufactured by Beckman Coulter, Inc.) with a 100-μm aperture. Here, 13 channels with the following ranges were used for the measurement: not less than 2.00 μm and less than 2.52 μm; not less than 2.52 μm and less than 3.17 μm; not less than 3.17 μm and less than 4.00 μm; not less than 4.00 μm and less than 5.04 μm; not less than 5.04 μm and less than 6.35 μm; not less than 6.35 μm and less than 8.00 μm; not less than 8.00 μm and less than 10.08 μm; not less than 10.08 μm and less than 12.70 μm; not less than 12.70 μm and less than 16.00 μm; not less than 16.00 μm and less than 20.20 μm; not less than 20.20 μm and less than 25.40 μm; not less than 25.40 μm and less than 32.00 μm; and not less than 32.00 μm and less than 40.30 μm. Namely, particles having a particle diameter not less than 2.00 μm and less than 40.30 μm were measured.

Toner Evaluating Methods

[1] Hot Offset Resistance

Each developer and paper sheets TYPE 6200 (manufactured by Ricoh Co., Ltd.) were set in a copier MF2200 (manufactured by Ricoh Co., Ltd.) having a TEFLON (registered trademark) roller as the fixing roller and whose fixing unit had been modified, and a copying test was performed. The fixing temperature was changed to determine the hot offset occurring temperature (i.e., upper-limit fixable temperature) to evaluate hot offset resistance. Hot offset resistance was evaluated under the conditions in which the sheet feeding linear speed was 50 mm/s, the surface pressure was 2.0 kgf/cm$^2$, and the nip width was 4.5 mm.

The criteria for determining the degree of hot offset resistance are as follows.

Very good: The upper-limit fixable temperature is 195 degrees C. or higher.

Good: The upper-limit fixable temperature is 190 degrees C. or higher and lower than 195 degrees C.

Average: The upper-limit fixable temperature is 180 degrees C. or higher and lower than 190 degrees C.

Poor: The upper-limit fixable temperature is lower than 180 degrees C.

[2] Low-Temperature Fixability

Each developer and paper sheets TYPE 6200 (manufactured by Ricoh Co., Ltd.) were set in a copier MF2200 (manufactured by Ricoh Co., Ltd.) having a TEFLON (registered trademark) roller as the fixing roller and whose fixing unit had been modified, and a copying test was performed. The fixing temperature was changed to determine the cold offset occurring temperature (i.e., lower-limit fixable temperature) to evaluate low-temperature fixability. Low-temperature fixability was evaluated under the conditions in which the sheet feeding linear speed was from 120 to 150 mm/s, the surface pressure was 1.2 kgf/cm$^2$, and the nip width was 3 mm.

The criteria for determining the degree of low-temperature fixability are as follows.

Very good: The lower-limit fixable temperature is lower than 140 degrees C.

Good: The lower-limit fixable temperature is 140 degrees C. or higher and lower than 150 degrees C.

Average: The lower-limit fixable temperature is 150 degrees C. or higher and lower than 160 degrees C.

Poor: The lower-limit fixable temperature is 160 degrees C. or higher.

[3] Filming

Each developer and A4-size plain paper sheets having a basis weight of 67 g/m$^2$ were set in a copier MP9001 (manufactured by Ricoh Co., Ltd.), and a continuous printing on 100 sheets was repeatedly performed 50 times. After that, the photoconductor was visually observed to evaluate the degree of filming.

The criteria for determining the degree of filming are as follows.

Very good: No filming has occurred on the photoconductor.

Good: Filming has slightly occurred on the photoconductor.

Average: Filming has occurred on a part of the photoconductor.

Poor: Filming has occurred on the entire surface of the photoconductor.

[4] Defective Toner Supply when using MOHNO PUMP

A MOHNO PUMP (manufactured by Ricoh Co., Ltd.) was operated 0.2 seconds, followed by a pause of 0.5 seconds, in a repeating manner so that toner supply was repeated. Assuming that the repeated toner supply for 17 hours was equivalent to printing on 500,000 sheets, the number of sheets in which defective toner supply had occurred was determined to evaluate the degree of defective toner supply occurred when using MOHNO PUMP.

The criteria for determining the degree of defective toner supply occurred when using MOHNO PUMP are as follows.

Very good: The equivalent number of sheets in which defective toner supply has occurred is 3 million or more.

Good: The equivalent number of sheets in which defective toner supply has occurred is 2.5 million or more and less than 3 million.

Average: The equivalent number of sheets in which defective toner supply has occurred is 2 million or more and less than 2.5 million.

Poor: The equivalent number of sheets in which defective toner supply has occurred is less than 2 million.

[5] Comprehensive Judgment

In a case in which all the evaluation results in [1] to [4] were A, B, or C was judged "Good". In a case in which at least one of the evaluation results in [1] to [4] was D was judged as "Poor".

Synthesis of Unmodified Polyester

In a reaction vessel equipped with a condenser tube, a stirrer, and a nitrogen introducing tube, 229 parts of ethylene oxide 2 mol adduct of bisphenol A, 529 parts of propylene oxide 3 mol adduct of bisphenol A, 208 parts of terephthalic acid, 46 parts of adipic acid, and 2 parts of dibutyltin oxide were put and allowed to react under normal pressure at 230 degrees C. for 8 hours. Next, after conducting a reaction under reduced pressures of 10 to 15 mmHg for 5 hours, 44 parts of trimellitic anhydride were put into the reaction vessel and allowed to react under normal pressure at 180 degrees C. for 2 hours. Thus, an unmodified polyester was prepared.

The unmodified polyester was found to have a number average molecular weight of 2,700, a weight average molecular weight of 6,900, a glass transition temperature of 45.1 degrees C., and an acid value of 22 mgKOH/g.

Preparation of Master Batch

First, 1,200 parts of water, 540 parts of a carbon black PRINTEX 35 (manufactured by Degussa) having a DBP oil absorption of 42 ml/100 mg and a pH of 9.5, and 1,200 parts of the unmodified polyester were mixed using a HENSCHEL MIXER (manufactured by Mitsui Mining Co., Ltd.), and then kneaded using a two-roll mill at 150 degrees C. for 30 minutes.

Next, the kneaded product was rolled and cooled, and then pulverized using a pulverizer (manufactured by Hosokawa Micron Corporation) to obtain a master batch.

Synthesis of Polyester having Hydroxyl Group

In a reaction vessel equipped with a condenser tube, a stirrer, and a nitrogen introducing tube, 682 parts of ethylene oxide 2 mol adduct of bisphenol A, 81 parts of propylene oxide 2 mol adduct of bisphenol A, 283 parts of terephthalic acid, 22 parts of trimellitic anhydride, and 2 parts of dibutyltin oxide were put and allowed to react under normal pressure at 230 degrees C. for 8 hours. Next, a reaction was conducted under reduced pressures of 10 to 15 mmHg for 5 hours. Thus, a polyester having a hydroxyl group was prepared.

The polyester having a hydroxyl group was found to have a number average molecular weight of 2,100, a weight average molecular weight of 9,500, a glass transition temperature of 55 degrees C., an acid value of 0.5 mgKOH/g, and a hydroxyl value of 51 mgKOH/g.

Synthesis of Polyester Prepolymer having Isocyanate Group

In a reaction vessel equipped with a condenser tube, a stirrer, and a nitrogen introducing tube, 410 parts of the polyester having a hydroxyl group, 89 parts of isophorone diisocyanate, and 500 parts of ethyl acetate were put and allowed to react at 100 degrees C. for 5 hours. Thus, a polyester prepolymer having an isocyanate group was prepared.

The polyester prepolymer having an isocyanate group was found to contain free isocyanate in a proportion of 1.53% by mass.

Synthesis of Ketimine

In a reaction vessel equipped with a stirrer and a thermometer, 170 parts of isophoronediamine and 75 parts of methyl ethyl ketone were put and allowed to react at 50 degrees C. for 5 hours. Thus, a ketimine was prepared.

The ketimine was found to have an amine value of 418 mgKOH/g.

Preparation of Resin Particle Dispersion Liquid

In a reaction vessel equipped with a stirrer and a thermometer, 683 parts of water, 11 parts of a reactive emulsifier (sodium salt of sulfate of ethylene oxide adduct of methacrylic acid) ELEMINOL RS-30 (manufactured by Sanyo Chemical Industries, Ltd.), 83 parts of styrene, 83 parts of methacrylic acid, 110 parts of butyl acrylate, and 1 part of ammonium persulfate were put and stirred at a revolution of 400 rpm for 15 minutes. Next, after the temperature was raised to 75 degrees C. and a reaction was conducted for 5 hours, 30 parts of a 1% by mass aqueous solution of ammonium persulfate were added to the vessel, and an aging was performed at 75 degrees for 5 hours. Thus, a resin particle dispersion liquid was prepared.

The volume average particle diameter of the resin particle dispersion liquid was measured using a NANOTRAC particle size distribution analyzer UPA-EX150 (manufactured by Nikkiso Co., Ltd.) and found to be 105 nm. A part of the resin particle dispersion liquid was dried to isolate the resin, and the glass transition temperature and the weight average molecular weight of the resin were measured and found to be 59 degrees C. and 150,000, respectively.

Synthesis of Ester Wax

In a four-neck flask equipped with a Dimroth reflux condenser and a Dean-Stark water separator, 1,740 parts of benzene, 1,300 parts of a mixture of behenic acid and stearic acid as long-chain alkylcarboxylic acid components, and 1,200 parts of a mixture of behenyl alcohol and stearyl alcohol as long-chain alkyl alcohol components, and 120 parts of p-toluenesulfonic acid were put and sufficiently stirred to dissolve. Next, after 5 hours of reflux, the valve of the water separator was opened, and azeotropic distillation was carried out. The resulted product was thoroughly washed with sodium hydrogen carbonate and dried to distill the benzene away. The resulted product was recrystallized, washed, and purified, thus obtaining an ester wax.

The compositions and addition amounts of the long-chain alkylcarboxylic acid components and the long-chain alkyl alcohol components were appropriately adjusted to control the melting points of resulting waxes 1 to 3, 5, and 6 to be 60 to 85 degrees C. (see Table 1).

Example 1

Preparation of First Liquid

In a reaction vessel equipped with a stirrer and a thermometer, 378 parts of the unmodified polyester, 120 parts of the wax 1, and 947 parts of ethyl acetate were put and stirred, and the temperature was raised to 80 degrees C. Next, the temperature was held at 80 degrees C. for 5 hours, then cooled to 30 degrees C. over a period of 1 hour. Next, 500 parts of the master batch, 25 parts of an organically-modified montmorillonite CLAYTONE (manufactured by BYK Additives & Instruments), and 500 parts of ethyl acetate were put into the reaction vessel and mixed for 1 hour. Thus, a toner material liquid was obtained.

Next, 1,324 parts of the toner material liquid were transferred to a reaction vessel and allowed to pass 3 times a bead mill ULTRAVISCOMILL (manufactured by AIMEX CO., Ltd.) filled with 80% by volume of zirconia beads having a diameter of 0.5 mm, under a liquid feeding speed of 1 kg/h and a disc peripheral speed of 6 m/s. Thus, a toner material dispersion liquid (A) was prepared. Next, 1,324 parts of a 65% by mass ethyl acetate solution of the unmodified polyester were put in a reaction vessel and allowed to pass the bead mill once under the same conditions as above. Thus, a toner material dispersion liquid (B) was prepared. Next, 200 parts of the toner material dispersion liquid (B) were stirred using a T.K. HOMODISPER (manufactured by Tokushu Kika Kogyo Co., Ltd.) at 8,000 rpm for 20 minutes. Thus, a toner material dispersion liquid (C) was prepared.

In a reaction vessel, 749 parts of the toner material dispersion liquid (C), 115 parts of the polyester prepolymer having an isocyanate group, and 2.9 parts of ketimine were put and mixed using a TK HOMOMIXER (manufactured by Tokushu Kika Kogyo Co., Ltd.) at 5,000 rpm for 1 minute. Thus, a first liquid was prepared.

Preparation of Aqueous Medium

An aqueous medium was prepared by stir-mixing 990 parts of water, 83 parts of the resin particle dispersion liquid, 37 parts of a 48.5% by mass aqueous solution of sodium dodecyl diphenyl ether disulfonate, ELEMINOL MON-7 (manufactured by Sanyo Chemical Industries, Ltd.), 135 parts of a 1% by mass aqueous solution of carboxymethyl cellulose sodium as a polymer protective colloid, CELLOGEN BS-H-3 (manufactured by DKS Co., Ltd.), and 90 parts of ethyl acetate.

Preparation of Second Liquid

A second liquid was prepared by mixing 867 parts of the first liquid in 1,200 parts of the aqueous medium using a TK HOMOMIXER (manufactured by Tokushu Kika Kogyo Co., Ltd.) at 13,000 rpm for 20 minutes.

Preparation of Third Liquid

The second liquid was put into a reaction vessel equipped with a stirrer and a thermometer, and desolvated at 30 degrees C. for 8 hours, then aged at 45 degrees C. for 4 hours to form base particles. Thus, a third liquid was prepared.

Washing and Drying of Base Particles

The third liquid in an amount of 100 parts by mass was filtered under reduced pressures. To the resulted filter cake, 100 parts of ion-exchange water were added and mixed using a TK HOMOMIXER at 12,000 rpm for 10 minutes, followed by filtration.

To the resulted filter cake, a 10% by mass aqueous solution of phosphoric acid was added to adjust the pH to 3.7 and mixed using a TK HOMOMIXER (manufactured by Tokushu Kika Kogyo Co., Ltd.) at 12,000 rpm for 10 minutes, followed by filtration.

To the resulted filter cake, 300 parts of ion-exchange water were added and mixed using a TK HOMOMIXER (manufactured by Tokushu Kika Kogyo Co., Ltd.) at 12,000 rpm for 10 minutes, followed by filtration. This operation was repeated twice.

The resulted filter cake was dried using a circulating air drier at 45 degrees C. for 48 hours, and then sieved with a mesh having an opening of 75 μm. Thus, base particles were prepared.

Preparation of Toner

Using a HENSCHEL MIXER 20A (manufactured by Mitsui Mining Co., Ltd.), 100 parts of the base particles, 1.5 parts of a hydrophobic silica, and 0.5 part of titanium oxide were mixed for 10 minutes under a mixer temperature of 35 to 40 degrees C. and a peripheral speed of 35 m/s, and then sieved with a 500 mesh. Thus, a toner was prepared.

Example 2

A toner was prepared in the same manner as in Example 1 except that the addition amount of wax 1 was changed to 110 parts in "Preparation of First Liquid".

Example 3

A toner was prepared in the same manner as in Example 1 except that the number of passes in preparing the toner material dispersion liquid (A) was changed to 4 in "Preparation of First Liquid".

Example 4

A toner was prepared in the same manner as in Example 1 except that the number of passes in preparing the toner material dispersion liquid (A) was changed to 5 in "Preparation of First Liquid".

Example 5

A toner was prepared in the same manner as in Example 1 except that wax 1 was replaced with wax 2 in "Preparation of First Liquid".

Example 6

A toner was prepared in the same manner as in Example 1 except that wax 1 was replaced with wax 3 in "Preparation of First Liquid".

Example 7

A toner was prepared in the same manner as in Example 4 except that wax 1 was replaced with wax 3 in "Preparation of First Liquid".

Example 8

A toner was prepared in the same manner as in Example 7 except that the mixing was performed at 13,000 rpm for 15 minutes in "Preparation of Second Liquid".

Example 9

A toner was prepared in the same manner as in Example 7 except that the mixing was performed at 13,000 rpm for 25 minutes in "Preparation of Second Liquid".

Example 10

A toner was prepared in the same manner as in Example 7 except that wax 1 was replaced with a paraffin wax HNP-9

(manufactured by Nippon Seiro Co., Ltd., hereinafter "wax 4") having a melting point of 75 degrees C. in "Preparation of First Liquid".

Example 11

A toner was prepared in the same manner as in Example 7 except that wax 1 was replaced with wax 5 in "Preparation of First Liquid".

Example 12

A toner was prepared in the same manner as in Example 7 except that wax 1 was replaced with wax 6 in "Preparation of First Liquid".

Example 13

A toner was prepared in the same manner as in Example 7 except that the addition amount of wax 1 was changed to 100 parts and the number of passes in preparing the toner material dispersion liquid (A) was changed to 2 in "Preparation of First Liquid".

Comparative Example 1

A toner was prepared in the same manner as in Example 1 except that the number of passes in preparing the toner material dispersion liquid (A) was changed to 2 in "Preparation of First Liquid".

Comparative Example 2

A toner was prepared in the same manner as in Example 1 except that the number of passes in preparing the toner material dispersion liquid (A) was changed to 6 in "Preparation of First Liquid".

Comparative Example 3

A toner was prepared in the same manner as in Example 1 except that the addition amount of wax 1 was changed to 100 parts in "Preparation of First Liquid".

Preparation of Carrier

Using a homomixer, 21.0 parts of an acrylic resin solution having a solid content of 50% by mass, 6.4 parts of a guanamine solution having a solid content of 70% by mass, 7.6 parts of alumina particles having an average particle diameter of 0.3 μm and a volume resistivity of $1\times10^{14}$ Ω·cm, 65.0 parts of a silicone resin solution SR2410 (manufactured by Dow Corning Toray Co., Ltd.) having a solid content of 23% by mass, 1.0 part of an aminosilane SH6020 (manufactured by Dow Corning Toray Co., Ltd.), 60 parts of toluene, and 60 parts of butyl cellosolve were dispersed for 10 minutes to prepare a coating liquid.

Using a SPIRA COTA (manufactured by Okada Seiko Co., Ltd.), a burnt ferrite powder $(MgO)_{1.8}(MnO)_{49.5}(Fe_2O_3)_{48.0}$ having an average particle diameter of 25 μm, serving as a core material, was coated with the coating liquid, followed by drying, so that a coating film having an average film thickness of 0.15 μm was formed. Thus, a ferrite powder having a coating film was prepared. Next, the ferrite powder having a coating film was burnt using an electric furnace at 150 degrees C. for 1 hour, then cooled, and crushed using a sieve having an opening of 106 μm. Thus, a carrier having a weight average particle diameter of 35 μm was prepared.

The film thickness of the coating film can be determined by observing a cross section of the carrier using a transmission electron microscope.

Preparation of Developer

A developer was prepared by uniformly mixing 100 parts of the carrier and 7 parts of the toner for triboelectric charging, using a TURBULA MIXER of a type in which the container rolls for stirring an object.

Table 1 presents the measurement results of wax properties.

TABLE 1

| | Type | Melting Point [degrees C.] |
|---|---|---|
| Wax 1 | Ester Wax | 80 |
| Wax 2 | Ester Wax | 75 |
| Wax 3 | Ester Wax | 70 |
| Wax 4 | Paraffin Wax | 75 |
| Wax 5 | Ester Wax | 85 |
| Wax 6 | Ester Wax | 60 |

Table 2 presents the measurement results of toner properties.

TABLE 2

| | $PI_{2850}/PI_{828}$ | | | Volume | |
|---|---|---|---|---|---|
| | Average Value | Proportion of pixels with 0.2 or more [%] | Half Value Width | Average Particle Diameter [μm] | Wax |
| Example 1 | 0.19 | 10 | 0.13 | 5.1 | 1 |
| Example 2 | 0.10 | 10 | 0.13 | 5.1 | 1 |
| Example 3 | 0.19 | 6 | 0.13 | 5.1 | 1 |
| Example 4 | 0.19 | 5 | 0.10 | 5.1 | 1 |
| Example 5 | 0.19 | 10 | 0.13 | 5.1 | 2 |
| Example 6 | 0.19 | 10 | 0.13 | 5.1 | 3 |
| Example 7 | 0.19 | 5 | 0.10 | 5.1 | 3 |
| Example 8 | 0.19 | 5 | 0.10 | 6.0 | 3 |
| Example 9 | 0.19 | 5 | 0.10 | 4.8 | 3 |
| Example 10 | 0.19 | 5 | 0.10 | 5.1 | 4 |
| Example 11 | 0.19 | 5 | 0.10 | 5.1 | 5 |
| Example 12 | 0.19 | 5 | 0.10 | 5.1 | 6 |
| Example 13 | 0.10 | 5 | 0.15 | 5.1 | 3 |
| Comparative Example 1 | 0.19 | 11 | 0.13 | 5.1 | 1 |
| Comparative Example 2 | 0.19 | 4 | 0.10 | 5.1 | 1 |
| Comparative Example 3 | 0.09 | 10 | 0.13 | 5.1 | 1 |

Table 3 presents the evaluation results of the toners.

TABLE 3

| | Low-temperature Fixability | Hot Offset Resistance | Filming | Defective Toner Supply when using MOHNO PUMP | Comprehensive Judgment |
|---|---|---|---|---|---|
| Example 1 | Good | Good | Average | Average | Good |
| Example 2 | Good | Average | Average | Average | Good |
| Example 3 | Good | Good | Good | Good | Good |
| Example 4 | Good | Good | Very good | Very good | Good |

TABLE 3-continued

| | Low-temperature Fixability | Hot Offset Resistance | Filming | Defective Toner Supply when using MOHNO PUMP | Comprehensive Judgment |
|---|---|---|---|---|---|
| Example 5 | Good | Very good | Good | Good | Good |
| Example 6 | Good | Very good | Average | Average | Good |
| Example 7 | Good | Very good | Very good | Very good | Good |
| Example 8 | Good | Average | Very good | Very good | Good |
| Example 9 | Good | Very good | Good | Very good | Good |
| Example 10 | Good | Average | Average | Average | Good |
| Example 11 | Good | Average | Very good | Very good | Good |
| Example 12 | Good | Very good | Average | Average | Good |
| Example 13 | Good | Average | Average | Average | Good |
| Comparative Example 1 | Good | Average | Poor | Poor | Poor |
| Comparative Example 2 | Good | Poor | Very good | Very good | Poor |
| Comparative Example 3 | Good | Poor | Average | Average | Poor |

It is understood from Table 3 that the toilers of Examples 1 to 13 exhibit excellent low-temperature fixability and hot offset resistance and prevent the occurrence of filming and defective supply of toner when using a MOHNO PUMP.

By contrast, in the toner of Comparative Example 1, because the proportion of pixels in which $PI_{2850}/PI_{828}$ is 0.2 or more is 11%, filming and defective supply of toner when using a MOHNO PUMP easily occur.

In the toner of Comparative Example 2, because the proportion of pixels in which $PI_{2850}/PI_{828}$ is 0.2 or more is 4%, hot offset resistance is poor.

In the toner of Comparative Example 3, because the average value of $PI_{2850}/PI_{828}$ is 0.09, hot offset resistance is poor.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A toner comprising:

a binder resin; and a release agent, wherein, when the toner is subjected to a FTIR-ATR mapping within a measurement range in a 50 μm square, divided in 1,024 pixels each in a 1.56 μm square, an average value of an intensity ratio of an absorption spectrum peak at a wavenumber of 2850 $cm^{-1}$ to an absorption spectrum peak at a wavenumber of 828 $cm^{-1}$ in each of the pixels is from 0.10 to 0.19, and a proportion of pixels in which the intensity ratio is 0.20 or higher to all the pixels is from 5% to 10%.

2. The toner according to claim 1, wherein a frequency histogram of the intensity ratio with respect to all the pixels has a half value width of from 0.10 to 0.13.

3. The toner according to claim 1, Therein the toner has a volume average particle diameter of from 4.9 to 5.5 μm.

4. The toner according to claim 1, wherein the release agent comprises an ester wax.

5. The toner according to claim 4, wherein the ester wax has a melting point of from 70 to 80 degrees C.

6. A developer comprising:

the toner according to claim 1; and a carrier.

7. The toner according to claim 1, further comprising an organically-modified layered inorganic mineral.

8. The toner according to claim 7, wherein a proportion of the organically-modified layered inorganic mineral in the toner is from 0.2% to 2.0% by mass.

9. The toner according to claim 1, wherein the toner is present as particles, and wherein at least some of the binder resin and at least some of the release agent are present on a surface of the particles.

10. The toner according to claim 1, further comprising a charge controlling agent.

11. The toner according to claim 10, wherein a content of the charge controlling agent is from 0.1% to 10% by mass, relative to the binder resin.

12. The toner according to claim 10, wherein the charge controlling agent is fixed on a surface of base particles of the toner.

* * * * *